United States Patent [19]

Marconnet

[11] Patent Number: 4,954,995

[45] Date of Patent: Sep. 4, 1990

[54] DEVICE AND METHOD FOR PREPARING BITUMINOUS PRODUCTS

[75] Inventor: Guy Marconnet, Rive de Gier, France

[73] Assignee: Ermont C. M., Lorette, France

[21] Appl. No.: 350,437

[22] Filed: May 11, 1989

[30] Foreign Application Priority Data

May 13, 1988 [FR] France ..... 88 06474

[51] Int. Cl.[5] ..... B28C 5/14; B28C 5/20; F27B 7/16; F27B 7/34

[52] U.S. Cl. ..... 366/7; 366/25; 366/40; 366/42; 366/64; 432/111; 432/118

[58] Field of Search ..... 366/7, 15, 23, 24, 25, 366/40, 33, 34, 35, 37, 42, 50, 64, 66; 432/106, 110, 111, 105, 109, 118; 34/33, 132, 137

[56] References Cited

U.S. PATENT DOCUMENTS

| | | | |
|---|---|---|---|
| Re. 31,904 | 6/1985 | Mendenhall | 366/25 |
| 2,421,345 | 5/1947 | McConnaughay . | |
| 3,802,139 | 1/1989 | Sasaki | 366/25 X |
| 4,318,620 | 3/1982 | Malipier et al. | 366/25 |
| 4,395,129 | 7/1983 | Musil | 366/25 |
| 4,427,376 | 1/1984 | Ethyre et al. | 366/25 X |
| 4,616,934 | 10/1986 | Brock | 366/4 |
| 4,705,404 | 11/1987 | Bruggemann | 432/111 X |
| 4,787,938 | 11/1988 | Hawkins | 432/14 X |

FOREIGN PATENT DOCUMENTS

| | | | |
|---|---|---|---|
| 0114118 | 1/1984 | European Pat. Off. . | |
| 0183079 | 10/1985 | European Pat. Off. . | |
| 3110380 | 9/1982 | Fed. Rep. of Germany . | |
| 3414365 | 10/1985 | Fed. Rep. of Germany . | |
| 3423521 | 1/1986 | Fed. Rep. of Germany | 366/25 |
| 3616995 | 11/1987 | Fed. Rep. of Germany . | |

*Primary Examiner*—Harvey C. Hornsby
*Assistant Examiner*—Scott J. Haugland
*Attorney, Agent, or Firm*—Pollock, Vande Sande & Priddy

[57] ABSTRACT

A burner (13) and a conveyor (6) for aggregates (7) into the drum (2) penetrate into the drum at opposite ends (*2a, 2b*). Circulation of the gases inside the drum occurs in direction opposite to circulation of the aggregates. The burner has an elongated body (12) arranged in the axial direction of the drum. The drum comprises, from the inlet end (*2a*) to the outlet end (*2b*), a drying zone (21), a flame zone (22), a zone for introducing recycled mixes (23') and a heating and mixing zone (23). The device may be associated with a mixer (42) of the conventional type in which the bituminous products (11) leaving the drum (2) are mixed with liquid bitumen and worked. The invention enables coated products for road surfaces to be prepared without the production of bitumen vapor.

4 Claims, 3 Drawing Sheets

DEVICE AND METHOD FOR PREPARING BITUMINOUS PRODUCTS

FIELD OF THE INVENTION

The invention relates to a device for preparing bituminous products, using new aggregates and recycled bituminous mixes, as well as to a method and a device for preparing bituminous coated products, in particular for road surfaces, using intermediate bituminous products obtained by mixing recycled bituminous mixes with new aggregates which have been dried and heated beforehand.

BACKGROUND OF THE INVENTION

Devices for preparing bituminous coated materials for road surfaces, using new aggregates, liquid bitumen, used bituminous mixes which have been recycled and powdery products, are known. These devices generally consist of a cylindrical drum of large dimensions, mounted on a platform for rotation about its axis and slightly inclined relative to the horizontal plane. The new aggregates and powdery products are introduced into the drum at one of its ends and the recycled mix in granular form via a recycling ring surrounding the drum in an intermediate zone between its two ends.

A burner penetrates inside the drum at one of its ends and enables hot gases to be circulated inside the drum, these gases ensuring drying and heating of the materials circulating inside the drum.

Such a drum carries out both drying and heating of the cold and moist aggregates entering into the drum, heating of the recycled mix and mixing of the new aggregates and the recycled mix in contact with liquid bitumen supplied into the drum via an injection pipe.

The internal wall of the drum is equipped with vanes of varying shapes depending on the zones of the drum so as to ensure, as a result of rotation of the drum, transportion, stirring and/or lifting of the materials circulating inside the drum.

Compared to former methods where the aggregates were dried and heated inside a rotating drier and the liquid bitumen mixed inside a separate mixer having a stationary housing, the integration of the drying, heating and mixing functions inside the same drum has led to a certain simplification of the procedures and the materials involved. However, drying/mixing drums have the drawback that they give rise to the presence, inside the same enclosure, of a flame, very hot gases and liquid bitumen. This results in the bitumen vapor being entrained by the hot gases circulating inside the drum, which in turn leads to rapid clogging of the bag filters used to extract the dust from the gases leaving the drum and to the discharge of harmful vapors into the atmosphere. These drawbacks are particularly marked in the case of parallel-flow drying/mixing drums, i.e., drying-/mixing drums where the hot gases circulate inside the drum in the same direction as the solid matter.

It has therefore been proposed to return to the old idea of coating materials in which drying and heating of the aggregates on the one hand and mixing with liquid bitumen on the other hand are carried out in different enclosures.

However, this technique is not suited to the preparation of mixes using new aggregates and a certain proportion of recycled bituminous mix.

A new type of equipment, which may be referred to by the name "drier/recycler", and which performs both drying and heating of the new aggregates, reheating and melting of the recycled mix in granular form and mixing of the said mix with the dried and heated new aggregates, has therefore been devised. The intermediate bituminous product obtained at the outlet of the drier/recycler may be introduced into a mixer into which there is injected liquid bitumen which ensures the final coating of the granular products pre-coated inside the drier/recycler.

The drier/recyclers known and used to date are, however, designed in such a way that very hot gases come into contact with bituminous products, and in particular with the recycled mix, just before they leave the drum. In these known drying/recycling devices, the hot gases therefore entrain bitumen vapors which reappear in the atmosphere in the form of blue fumes well known to the operators of road surfacing plants.

SUMMARY OF THE INVENTION

The object of the invention, therefore, is to propose a device for preparing bituminous products, using new aggregates and recycled bituminous mixes, of the type having a cylindrical drum mounted rotatably about its axis and slightly inclined relative to the horizontal plane, through the ends of which penetrate a burner and means for conveying cold and moist aggregates into the drum, as well as a ring for introducing recycled mixes into the drum surrounding the latter in a zone for introducing the intermediate recycled mix between the ends of the drum and means for recovering the pre-coated bituminous products at the outlet of the drum as well as means for collecting the dust-laden gases circulating inside the drum, in which the burner on the one hand and the means for conveying aggregates into the drum on the other hand penetrate into the drum at opposite ends, circulation of the gases inside the drum taking place in the direction opposite to circulation of the aggregates, this device preventing pollution of the atmosphere by bitumen vapors and clogging of the gas dust-extraction filters, while retaining the flexibility of use of the most efficient known recycling devices of the prior art.

To this end:

the burner has an elongated body arranged along the axial direction of the drum and extending as far as a drum zone removed from the ends, in which the flame is produced, the drum comprising, from the inlet end for the aggregates to the opposite outlet end for the materials, into which outlet end the burner penetrates:

a drying zone in which the internal wall of the drum is equipped with lifting vanes, a flame zone in which the internal wall of the drum is equipped with vanes for keeping the material against the wall, and, situated entirely downstream of the flame zone and around the body of the burner, the zone for introducing recycled mixes followed by a heating and mixing zone in which the drum has on its internal surface vanes for mixing the dried and heated aggregates and recyled bituminous mix.

The invention also relates to a device for preparing bituminous coated products for road surfaces, this device comprising, in combination with the recycling/drying device according to the invention, a mixer having a stationary housing arranged at the outlet of the drum of the drying and recycling device.

BRIEF DESCRIPTON OF THE DRAWINGS

In order that the invention may be more clearly understood, a description now follows, with reference to the appended drawings, of an installation for preparing bituminous coated products for road surfaces, comprising a drying and recycling device according to the invention combined with a mixer having a stationary housing.

Figure 1:
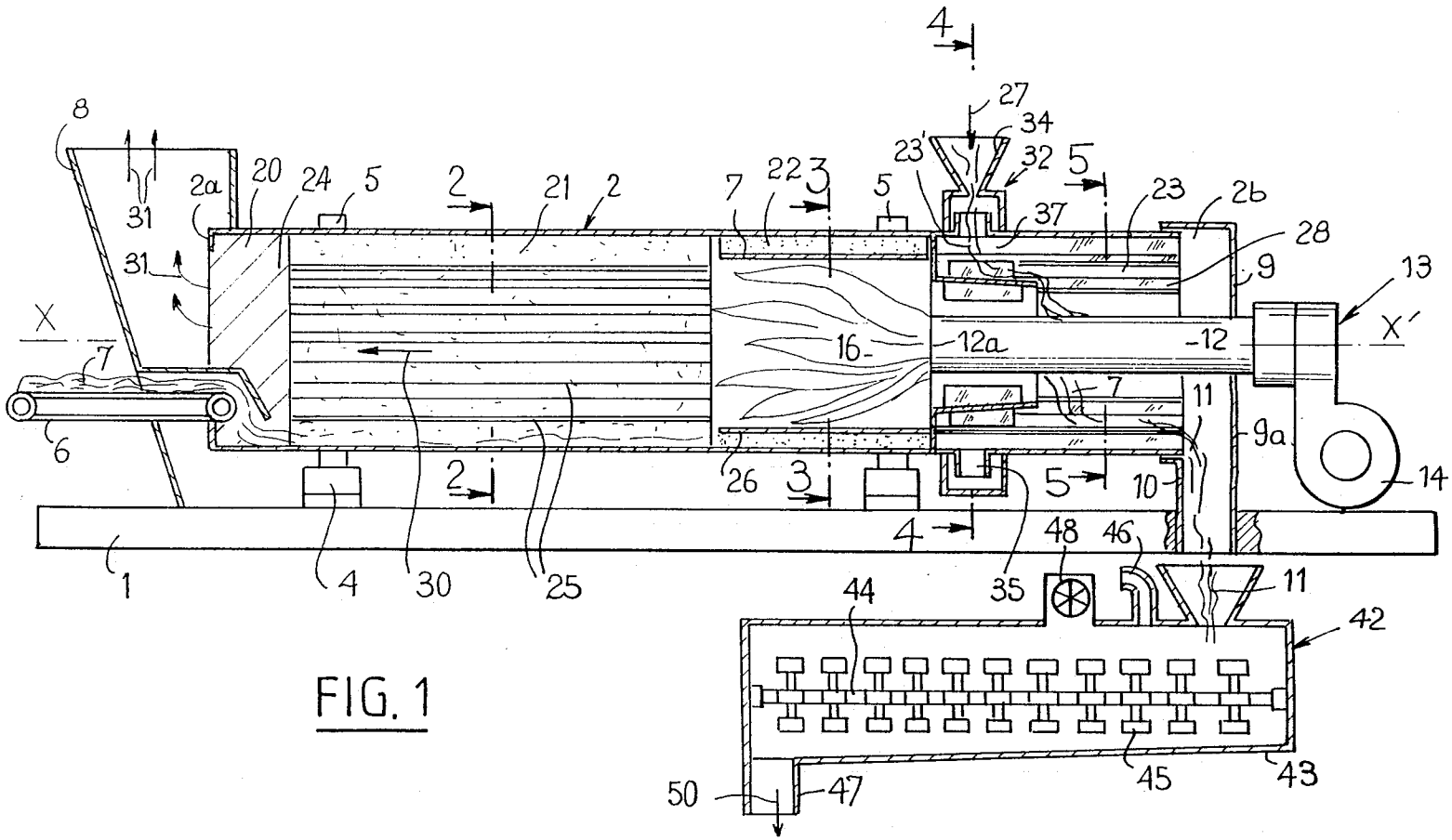
FIG. 1 is a longitudinal view through the surfacing installation comprising a drying and recycling device according to the invention.
Figure 3:
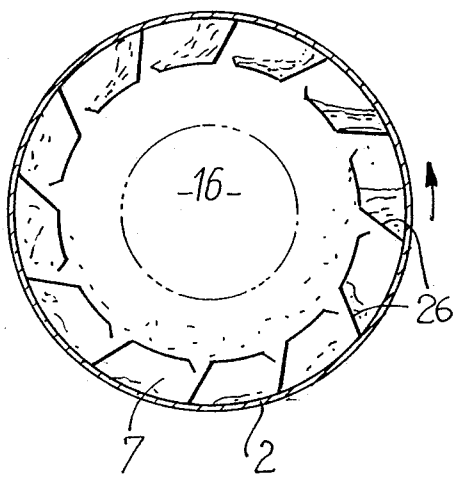

FIG. 3. is a sectional view along line 3—3 of FIG. 1.

Figure 4:
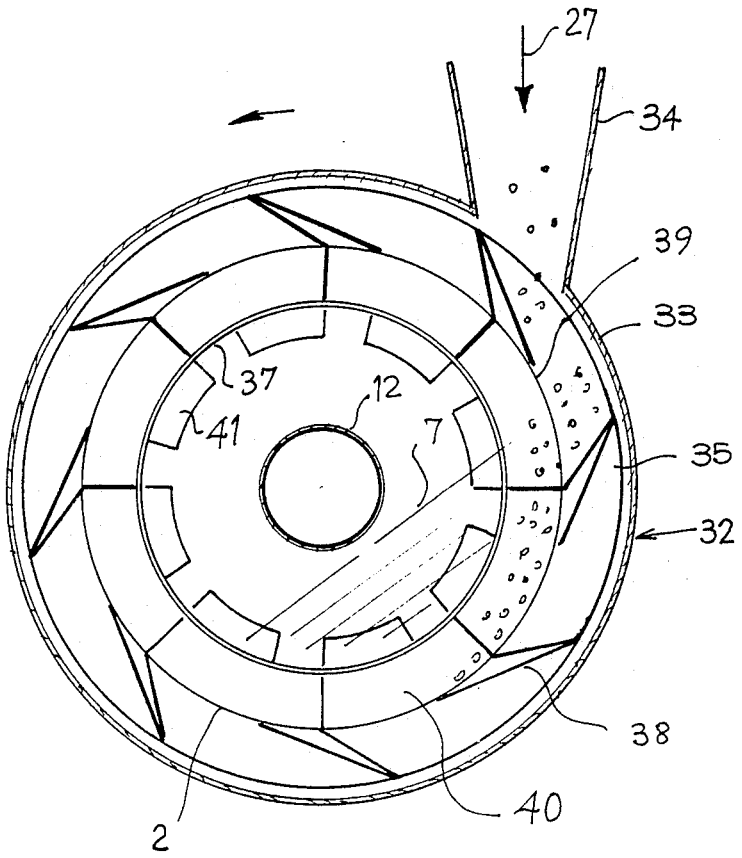

FIG. 4 is a view along line 4—4 of FIG. 1.

Figure 5:
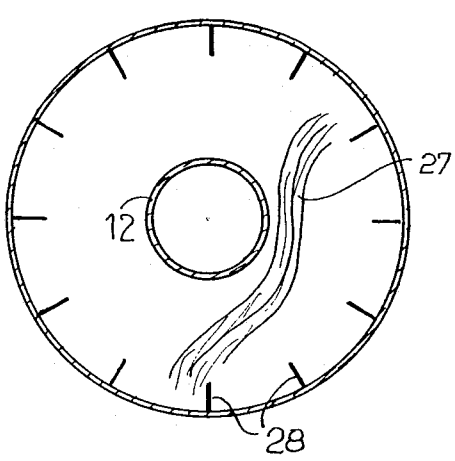

FIG. 5 is a view along line 5—5 of FIG. 1.

DESCRIPTION OF PREFERRED EMBODIMENT

FIG. 1 shows the installation which has a platform 1 supporting the drum 2 of the drier/recycler according to the invention. The platform 1 has devices (not shown) supporting it on the ground of the site, and means for adjusting its inclination relative to the horizontal plane, enabling the inclination of the axis X—X of the drum 2 of the drier/recycler to be adjusted.

In the case of a movable station, the platform 1 may consist of a road towing vehicle having extendable and retractable forked arms for positioning the device on the site.

The drum 2 has a cylindrical housing mounted on the platform for rotation about its axis X—X', by means of four rolling wheels 4 and two rolling rings 5 integral with the external surface of the housing of the drum.

The drum 2 has a first end 2*a* or inlet end through which the outlet end of a conveyor belt 6 penetrates, the latter enabling the drum to be supplied with cold and moist aggregates 7. The inlet end 2*a* of the drum is engaged inside a box 8 for sucking gases circulating inside the drum.

The outlet end 2*b* of the drum opposite its inlet end is engaged inside a fixed structure 9 comprising a vertical plate 9*a* and a chute 10 for pouring out and discharging materials 11 from the drum.

The plate 9*a* has passing through it the elongated cylindrical body 12 of a burner 13 comprising a fan 14 supported by the platform 1.

The burner body 12 arranged along the axis X—X' of the drum has one end 12*a* from which the flame 16 is produced, located further forward inside the drum than the outlet end 2*b*.

Advantageously, this end 12*a* may be situated at a distance from the end 2*b* of between one-quarter and one-third of the total length of the drum.

The drum 2 has, along its length, several successive zones which differ from each other as a result of the shape of the elements equipping the internal surface of the drum in the zone in question and as a result of the function performed by such zone when the device is in operation.

From the inlet end 2*a* of the drum to the outlet end 2*b*, the said drum has an introduction zone 20, a drying zone 21, a flame zone 22, a zone for introducing recycled mixes 23' and a heating and mixing zone 23. Consequently, the zone for introducing recycled mixes 23' separates and isolates the heating and mixing zone from the flame zone.

The zone 20 ensures rapid introduction of the aggregates 7 brought to the drum by the conveyor 6 into the drying zone 21. In this zone 20, the internal wall of the drum 2 is equipped with fins 24 projecting radially relative to the internal surface of the drum and arranged along helices having as their axes the axis X—X of the drum.

Figure 2:
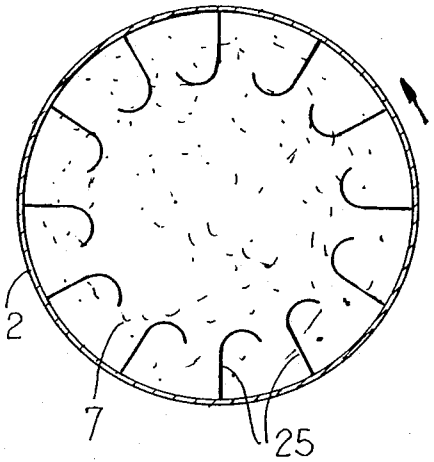
FIG. 2 is a sectional view along line 2—2 of FIG. 1.

In the zone 21, as can be seen in FIG. 2, the internal surface of the drum 2 is equipped with lifting vanes 25, the cross-section of which is hook-shaped, enabling the aggregrates 7 to be lifted to the top part of the drum and to form a continuous screen of aggregates falling in cascade fashion over the cross-section of the drum during rotation of the latter. The continuous screen of aggregates is then passed through by the hot gases produced by the flame 16 of the burner situated in the zone 22 and circulating in the axial direction of the drum (arrow 30). The drum is inclined so that its inlet end 2*a* is a higher level than its outlet end 2*b*. The solid materials and in particular the aggregates 7 therefore circulate inside the drum in the direction opposite to the direction of circulation 30 of the hot gases. The cold and moist aggregates 7 upon entering into the drum are dried and heated by hot gases circulating in the opposite direction. Upon leaving via the suction box 8 (arrow 31), the gases are laden with dust released by the aggregates 7 during drying thereof.

As can be seen in FIG. 3, in the flame zone 22, the internal wall of the drum 2 is equipped with vanes 26 enabling the dried and heated aggregates 7 to be kept inside the zone 21 against the internal wall of the drum 2. The vanes 26 consisting of strips of folded sheet metal have a concave section directed towards the wall of the drum and an external practically flat surface directed toward the flame 16. The vanes 26 are fixed along one of their edges onto the surface of the drum, the opposite edge of the vane forming a gap of small width relative to the wall of the drum, so as to allow the vanes to be filled and a limited amount of aggregates 7 to be poured out when the drum is rotated.

The vanes 26, which have a shape which is conventional in the technical field of drying and coating drums, allow a free zone to be provided in the central part of the drum, inside which the flame 16 can be produced.

As can be seen in FIG. 4, inside the zone 23', the drum 2 is surrounded by the recycling ring 32 which has a fixed annular part 33 forming at its top a hopper 34 for introducing recycled materials 27 and a movable annular part 35, intergral with the external wall of the drum, comprising sprouts 38 and through-openings 39 towards the inside of the drum, so as to cause the recycled materials poured into the hopper 34 to pass inside the zone 23' of the drum.

In a known manner, a small internal drum 37 is fixed inside the drum 2 in a coaxial manner and ensures that the recycled materials introduced inside the drum pass into the zone 23 situated downstream of the recycling ring 33.

Helical fins 40 are fixed on the external surface of the drum 37 so as to ensure transportation of the recycled mix. Helical fins 41 are fixed on the inside of the drum 37 so as to ensure transportation of the dried and heated aggregates. The recycled mix 27 and the aggregates 7 are then introduced into the inlet of the zone 23 from the outside and from the inside of the drum 37, respectively.

As can be seen in FIG. 5, the internal surface of the drum 2 is equipped with flat vanes 28 in the zone 23 situated downstream of the zone for introducing recycled mixes.

The recycled materials 27 introduced into the drum are then intimately mixed with the aggregates 7 coming from the drying zone 21, by means of the flame zone 22 and the drum 37.

The vanes 28 stir the bed of granular matter consisting of the aggregates 7 annd the bituminous mix 27. Stirring is carried out without significant raising of the bed of materials, which remains in contact with the wall of the drum.

The aggregates entering into the zone 23 have been dried and heated inside the zone 21 and inside the zone 22 and are therefore at a high temperature when they come into contact with the recycled mix 27. The recycled mix is therefore heated by contact with the aggregates, thus producing a softening and melting of the bitumen layer covering the recycled mix. The molten bitumen covers at least partially the aggregates during mixing such that, at the outlet of the drum, the products poured through the chute 10 consist partly of the recycled materials covered with molten bitumen and partly of precoated aggregates.

It should be noted that heating of the recycled mix and mixing with the aggregates are performed in a calm zone which is not subjected to the circulation of the hot gases arising inside the zone 22, at the outlet 12*a* of the burner 13.

The bituminous materials circulating inside the zone 23 are therefore not subjected to hot circulating gases, which risk entraining bitumen vapors toward the outlet of the drum.

In reality, limited vaporization of the bitumen of the recycled materials may occur in the zone 23, but the small quantity of vapor produced, mixed with the water vapor resulting from drying of the recycled materials in the zone 23, is entrained towards the zone 22 where it must pass through the flame 16 which causes complete combustion of the bitumen vapors.

The gases emerging via the suction box 8 therefore no longer contain any bitumen vapors.

The hot pre-coated bituminous products poured through the chute 10 are introduced into a mixer 42 of the conventional type fixed underneath the platform 1. The mixer 42 has a stationary housing 43 inside which are rotatably mounted two shafts 44 carrying mixing arms 45. Liquid bitumen is introduced into the mixer, for example by means of an injection pipe 46.

The powdery substances recovered from the gases emerging via the flue 8 are introduced into the inlet of the mixer so as to obtain a correctly metered amount of powdery substances in the coated products obtained at the outlet of the mixer. A device 48 enables recycled powdery substances or other powdery additives to be introduced into the mixer.

Driving means (not shown) ensure rotation of the shafts 44 so as to mix the hot intermediate bituminous materials with liquid bitumen and powdery products. The coated products 50 obtained are poured through a chute 47 from where they may be stored for transportation and use on a roadwork site.

In the case where the starting aggregates contain a large quantity of powdery substances (powdery aggregates), the powdery substances separated from the aggregates during drying and entrained by the gases are not reintroduced into the mixer, since the residual quantity of powdery substances at the drum outlet may be sufficient to obtain satisfactory properties for the mix.

It should be noted that the small drum 37 of the zone for introducing recycled mixes 23' concentrates the gases in the central zone of the drum 2. This embodiment allows the vapors released by the materials recycled in the heating zone 23 to be directed towards the central part of the zone 22, i.e., towards the flame 16, where they are burned.

The main advantages of the device according to the invention are that it carries out heating and mixing of the recycled mix with the new aggregates, in a calm zone which is not subjected to the circulation of hot gases, while ensuring an efficient heating action and proper integration of the recycled mix with the new aggregates.

The device according to the invention makes it possible to use a proportion of recycled materials constituting up to 80% by weight of the total quantity of solid matter. The device also makes it possible to eliminate pollution of the atmosphere by the bitumen vapors and to ensure satisfactory operation of the dust extraction filters which are no longer clogged by bitumen.

Moreover, since there is no additional supply of heat by hot gases or a flame inside the mixer, the liquid bitumen is not capable of producing polluting vapors during the final stage of coating.

As has been indicated above, the device and the method according to the invention enable surplus fines to be easily eliminated in the case of dust-containing aggregates.

It is also possible to introduce additives, such as liquid or fiber doping products, into the mixer, i.e., into a zone to which there is easy access outside the drum.

The device according to the invention may be easily substituted for a conventional drier, in a discontinuous station according to the prior art, so as to incorporate a certain proportion of recycled materials into the new materials.

In the case where a powdery material is introduced in order to adjust the composition of the mix or in order to obtain coloring of this mix (for example red mix), the powdery material may be introduced directly into the mixer without the risk of vapor escaping and powdery material being released.

The device according to the invention may also be used to manufacture cold products such as a water-bound sand-and-gravel mixture or emulsified bituminous mix. In this case, the components of the mixture may be introduced via the inlet of the recycling ring.

The drying/recycling device according to the invention may be used with a continuous or discontinuous mixer having one or two shafts, amd more generally with a mixer of any type.

The drum 2 may have a diameter substantially smaller (by 20 to 25%) in the heating and mixing zone than its diameter in the drying zone and in the flame zone.

The vanes equipping the different zones of the drum may have shapes different from those which have been described, provided that the lifting or retaining or mixing functions in these different zones are correctly performed.

The device and the method according to the invention apply to the manufacture of any bituminous product using new aggregates and recycled mixes.

I claim:

1. Device for preparing bituminous coated products from virgin aggregates and recycled bituminous mixes, said device comprising (a) a cylindrical drum (2) mounted for rotation about an axis (XX') of said drum and slightly inclined relative to a horizontal plane;

(b) a burner penetrating through a first end of said drum, said burner having an elongated body (12) extending axially of said drum (2) as far as a flame zone (22), removed from said first end and a second end (2*a*, 2*b*) of said drum, in which a flame (16) is produced;

(c) means (6) for conveying cold and moist aggregates into the drum (2) penetrating through said second end of said drum opposite first end;

(d) a ring (32) for introducing recycled mixes into said drum surrounding said drum in a zone for introducing an intermediate recycled mix between said first and second ends of said drum;

(e) means (10) for recovering precoated bituminous products at an outlet of said drum (2);

(f) means (8) for collecting dust-laden gases circulating inside said drum, circulation of the gases inside said drum taking place in a direction opposite to circulation of the aggregates (7);

(g) said drum comprising, sequentially from said first end (2*a*) to said second end (2*b*):

(i) a drying zone (21) in which an internal wall of said drum (2) is provided with lifting vanes (25);

(ii) said flame zone (22) in which said internal wall of the drum is provided with vanes (26) for keeping aggregates (7) against said internal wall of said drum (2); and (iii) a zone situated entirely downstream of said flame zone (22) and around said body of said burner, for introducing recycled mixes (23'), followed by a heating and mixing zone (23) in which said drum is provided on its internal surface with vanes (28) for mixing dried and heated aggregates and recycled bituminous mix, said device further comprising recovery means and a mixer (42) having a stationary housing (43) arranged at the outlet of said drum (2) so as to receive the bituminous products leaving said drum (2) by said recovery means (10), mixing means (44, 45) and a means (46) for introducing liquid bitumen into the stationary housing (43) of said mixer.

2. Device according to claim 1, wherein said mixer is of the continuous type.

3. Device according to claim 2, wherein said mixer (40) comprises means for introducing a powdery product into said stationary housing (43).

4. Method for preparing bituminous coated products from virgin aggregates, recycled bituminous mixes and liquid bitumen, said method comprising the steps of (a) drying and heating said virgin aggregates by circulating hot gases in a direction opposite to a direction of movement of said virgin aggregates;

(b) heating said recycled bituminous mix in granular form by bringing it into contact with said dried and heated virgin aggregates;

(c) mixing said virgin aggregates and recycled bituminous mix so as to pre-coat said virgin aggregates;

(d) introducing the mixture of recycled bituminous mix and hot pre-coated virgin aggregates into a mixer; and (e) mixing said pre-coated virgin aggregates and recycled bituminous mix with liquid bitumen.

* * * * *